United States Patent [19]

Ludman

[11] Patent Number: 4,539,651

[45] Date of Patent: Sep. 3, 1985

[54] OPTICAL CORRELATOR

[76] Inventor: Jacques E. Ludman, 98 Old Lowell, Westford, Mass. 01731

[21] Appl. No.: 465,227

[22] Filed: Feb. 9, 1983

[51] Int. Cl.[3] ..... G06G 9/00

[52] U.S. Cl. ..... 364/822; 364/819; 350/162.13

[58] Field of Search ..... 364/800, 807, 819, 822, 364/826-827; 350/162.11, 162.12, 162.13

[56] References Cited

U.S. PATENT DOCUMENTS

| | | | |
|---|---|---|---|
| 3,493,288 | 2/1970 | Kaufman et al. | 350/163 |
| 3,585,705 | 6/1971 | Allan | 29/412 |
| 3,867,639 | 2/1975 | Engel | 364/822 X |
| 4,059,343 | 11/1977 | Kowalski et al. | 350/182 |
| 4,089,586 | 5/1978 | French et al. | 350/96.30 |
| 4,095,899 | 6/1978 | Vanasse | 356/106 |
| 4,110,016 | 8/1978 | Berg et al. | 364/822 X |
| 4,139,277 | 2/1979 | Berg et al. | 364/822 X |
| 4,147,979 | 4/1979 | Baues et al. | 324/244 |
| 4,370,024 | 1/1983 | Task et al. | 350/162.12 |
| 4,383,734 | 5/1983 | Huignard et al. | 350/162.13 |
| 4,461,541 | 7/1984 | Duthie | 350/162.12 X |

OTHER PUBLICATIONS

Weaver et al., "A Technique for Optically Convolving Two Functions", *Applied Optics,* vol. 5, No. 7, Jul. 1966, pp. 1248, 1249.

A. VanderLugt, "Signal Detection by Complex Spatial Filtering", *IEEE Transactions on Information Theory,* vol. IT-10, No. 2, Apr. 1969, pp. 139-145.

Döbele, H. F. et al., "Application of a Fabry Perot Spectrometer to the Measurement of Spectral Line Shifts much Smaller than Line Width", *Applied Optics,* vol. 15, No. 1, Jan. 1976, pp. 69-72.

*Primary Examiner*—Jerry Smith
*Assistant Examiner*—Gary V. Harkcom
*Attorney, Agent, or Firm*—Donald J. Singer; Jacob N. Erlich

[57] ABSTRACT

An optical correlator having a series of optical elements necessary for providing the comparison or correlation of incoming optical signals and for providing a readout beam representive of the correlation between the input signals; and a detection system which is capable of rapidly and reliably detecting intensity peaks in the readout beam. These intensity peaks establish the actual correlation between the optical input signals. The detection system incorporates therein a pair of optical fibers, one of which having associated therewith an electro-optic component for effectively varying the length of that fiber. By varying the effective length of one of the fibers, an intensity detector can provide an output of the intensity peaks necessary in making the actual correlation determination between the optical input signals.

10 Claims, 3 Drawing Figures

OPTICAL CORRELATOR

STATEMENT OF GOVERNMENT INTEREST

The invention described herein may be manufactured and used by or for the Government for governmental purposes without the payment of any royalty thereon.

BACKGROUND OF THE INVENTION

This invention relates generally to optical correlation systems and, more particularly, to an optical correlator and method of correlation which are capable of providing rapid and reliable optical signal processing.

Optical correlators are extremely useful in the processing of optical signals in, for example, the analysis of radar information or sonar information. More specifically, the optical correlator can effectively compare a pair of optical input signals and by an analysis of intensity peaks determine information with respect to the optical input signals. A major problem in two dimensional optical signal processing by means of current optical correlators is the lack of rapid read-out of output signals during the optical correlation procedure. For example, the result of a joint transform optical correlator may very well yield a correlation peak located somewhere in a $10^3 \times 10^3$ array of possible locations and it may be required to determine the exact location in the order of one microsecond. In addition, since there are generally a large number of smaller secondary intensity peaks associated with this output, it is not only necessary to determine which peak is the largest, but also the exact location of this largest intensity peak.

Conventional optical correlators incorporate therein a plurality of intensity detector arrays which provide information with respect to each of the intensity peaks in order to determine which, in fact, is the largest and where the largest intensity peaks are located. Unfortunately, during use in analyzing of radar or sonar information, current optical correlators are generally incapable of handling large amounts of data in a rapid and reliable fashion. It is therefore highly desirable to provide an optical correlator which is capable of handling large amounts of data and in doing so in a minimal amount of time.

SUMMARY OF THE INVENTION

The present invention overcomes the problems encountered in the past and as set forth hereinabove by providing an optical correlator which incorporates therein a detector system which is capable of rapidly and reliably analyzing optical signals.

The optical correlator of the present invention can be broken down into two major systems. The first system includes the optical elements necessary for providing the comparison or correlation of incoming optical signals and for providing a readout beam representative of the correlation between the input signals. This readout beam is made up of a plurality of components of varying intensity with the wavefronts of each component being parallel to each other. The second system of the optical correlator of this invention is a detection system which is capable of rapidly and reliably detecting the intensity peaks in the readout beam, and, in conjunction with readily available mathematical techniques, establish the correlation between the optical input signals.

The detection system utilized with the optical correlator of this invention includes a pair of optical fibers of substantially the same optical length, with one end of each of the fibers being joined together or combined so as to form a single optical output path. The other end of one of the optical fibers has incorporated therewith a block of electo-optic material. In addition, this electro-optic material contains a pair of electrodes adjacent opposed sides of the electro-optic material. The electrodes are electrically connected to a controllable, variable voltage source which can create an electric field between the electrodes. By altering the voltage, the effective optical path length of the one optical fiber can be altered. By positioning the optical fibers at a preselected location within the readout beam, one of the optical fibers will, in essence, be capable of being "moved" with respect to the other optical fiber and with respect to the readout beam.

Associated with the end of this single optical output path of the pair of fibers in another optical fiber, any conventional intensity detector, in the form of, for example, a photodiode or photo-cell is optically aligned with the output optical fiber and is capable of measuring and detecting the intensity of the output emanating from this output fiber. If the output derived from the pair of fibers are combined in phase, the intensity detector will detect a maximum intensity. However, if the output derived from the pair of fibers, when combined, are out of phase, the intensity detector will detect no intensity.

Since the readout beam, as stated above, is comprised of components, each having parallel wavefronts, then the component corresponding to the major correlation peak will be the parallel component with the greatest intensity. Considering this component alone, by moving one of the fibers with respect to the other, the detection system of this invention will indicate the relative phase variations as a function of the fiber position. Conventional mathematical calculations can be utilized in a determination of the exact angle of the readout beam once it is determined how much the optical path length of one of the optical fibers must be moved in order for the intensity to vary from maximum to maximum at the detector. Since it is inappropriate to actually physically move the fibers back and forth, this invention provides the above described system of altering voltage within the electro-optic material surrounding one of the fibers in order to change the optical path length of that particular optical fiber.

It is therefore an object of this invention to provide an optical correlator which is capable of rapidly processing optical signals.

It is still another object of this invention to provide an optical correlator which is capable of reliably and rapidly processing large amounts of input data.

It is still a further object of this invention to provide an optical correlator which incorporates therein a uniquely designed detection system.

It is even a further object of this invention to provide an improved method of optical correlation.

It is still another object of this invention to provide an optical correlator which is economical to produce and which utilizes conventional, currently available components that lend themselves to standard mass producing manufacturing techniques.

For a better understanding of the present invention, together with other and further objects thereof, reference is made to the following description taken in conjunction with the accompany drawing and its scope will be pointed out in the appended claims.

DETAILED DESCRIPTION OF THE PREFERRED EMBODIMENT

Figure 1:
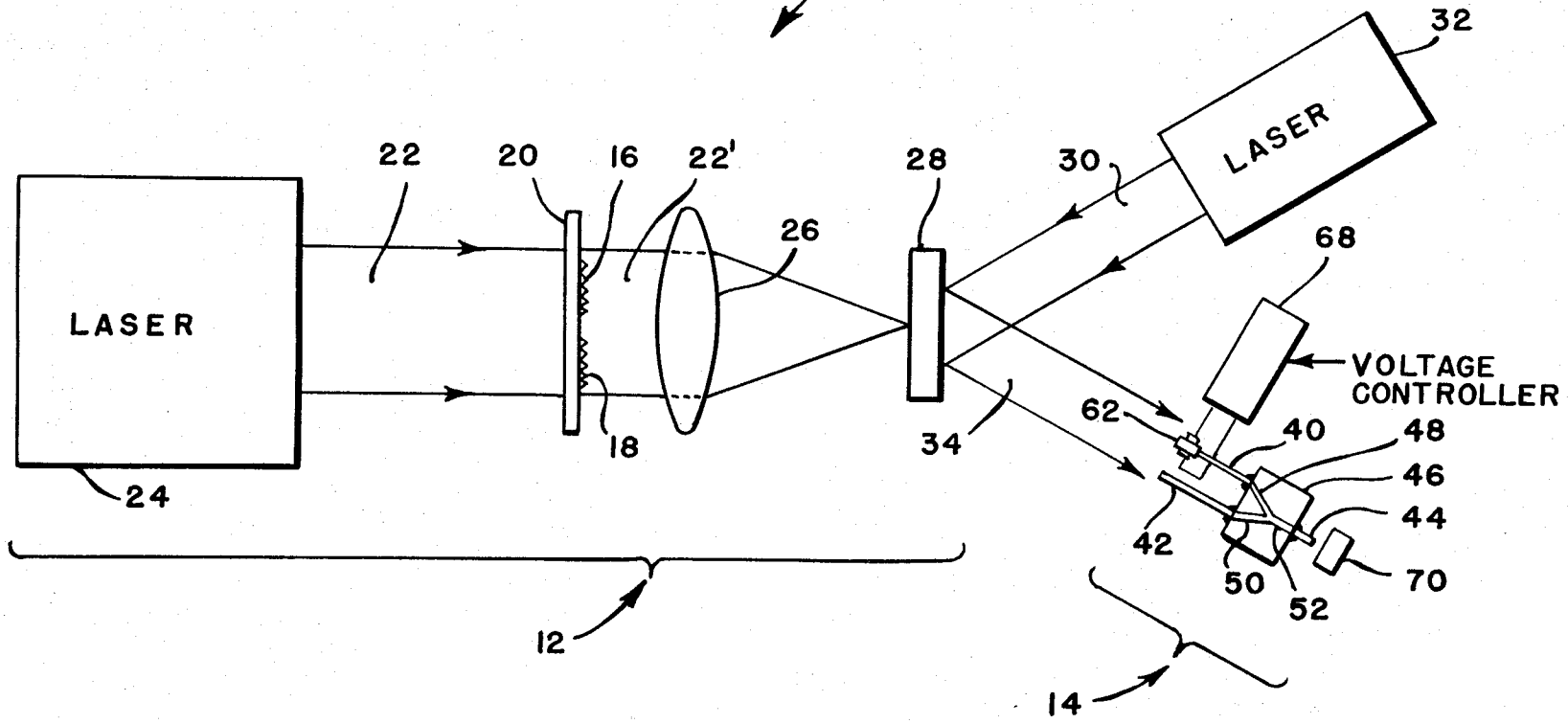
FIG. 1 is a schematic representation of the optical correlator of this invention.

Reference is now made to FIG. 1 of the drawing which illustrates in schematic fashion the optical correlator 10 of this invention. Optical correlator 10 of the present invention incorporates therein two component systems; first, a correlation or comparison system 12 and, second, a detecting or detection system 14.

As with most optical correlators, the comparison system 12 utilized with optical correlator 10 of this invention compares a pair of optical patterns 16 and 18 which are contained, for example, on a spatial light modulator (SLM) 20. A parallel input beam 22 emanating from, for example, a laser 24 provides a beam of light which passes through spatial light modulator 20. The modulated beam 22′ is then focused by means of a conventional transform lens 26 (which takes the Fourier transform of the patterns 16 and 18) in the plane of a second spatial light modulator 28. The second spatial light modulator 28 squares the sum of the Fourier transform, and records the resulting intensity pattern which mathematically correspond to the product of the Fourier transform of the patterns 16 and 18. A beam of light 30 produced by another laser 32 is used to "readout" patterns 16 and 18 and provide readout beam 34.

Figure 2:
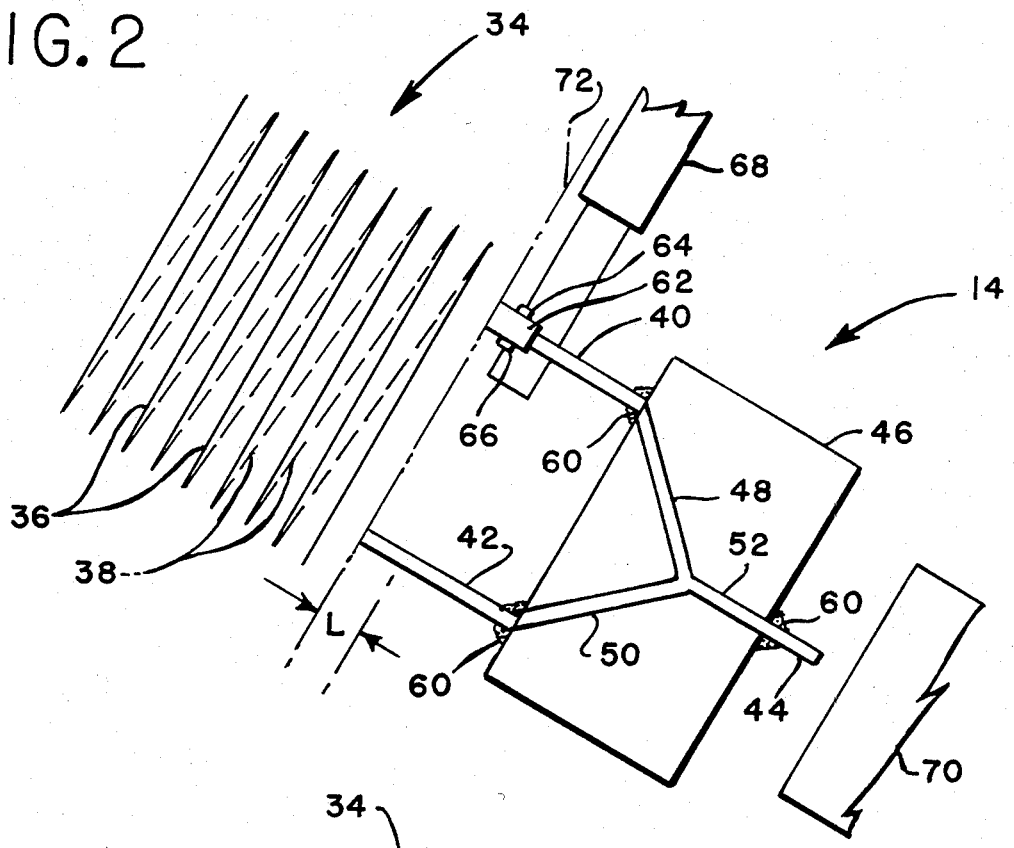
FIG. 2 is an enlarged, schematic illustration of the detection system of the optical correlator of this invention.

As illustrated in FIG. 2 of the drawing, the readout beam 34 is formed of a plurality of components of varying intensity. FIG. 2 illustrates two such components, 36 and 38, with the wavefronts of the higher intensity component 36 being depicted by solid lines and the wavefronts of the weaker intensity component 38 being depicted by dashed lines. The wavefronts of each component are parallel to each other and spaced apart from each other by predetermined distances corresponding to the wavelength of beam 34. It is the high intensity component 36 which is an indication of the correlation of the pair of optical signals or patterns 16 and 18 and which is of interest with the present invention.

Contrary to past optical correlators in which a plurality of intensity peaks in a transform readout beam are detected by a plurality of detector arrays, the present invention concentrates directly on the untransformed high intensity component 36 of readout beam 34 and is able to not only detect this component 36, but also determine its exact direction and therefore the location of the correlation. This is accomplished by the detection system 14 of the present invention which is clearly illustrated in FIGS. 1 and 2 of the drawing and described in detail hereinbelow.

Detection system 14 is made up of a pair of optical fibers 40 and 42. The optical fibers 40 and 42 are combined (in a Y-shaped configuration) to form a single output path terminating in optical fiber 44. In order to provide for this combining of fibers 40 and 42, a block 46 of electro-optic material, such as lithium niobate, has formed therein a pair of optical paths 48 and 50 of substantially the same length. The optical paths 48 and 50 are formed by means of any suitable diffusing technique such as diffusion within the electro-optic material of block 46 and combined to form a single optical path 52, thereby forming the overall Y-shaped configuration. The Y-shape provides first optical path 48, second optical path 50, with each of optical paths 48 and 50 combining into optical path 52 which terminates with optical fiber 44. The interconnection of optical fibers 40 and 42 with optical paths 48 and 50, respectively, can be accomplished by any suitable coupling means such as optical couplers or an adhesive, such as epoxy 60. In addition, the same type of adhesive may be utilized to couple optical fiber 44 to path 52 in block 46.

In addition to the above-mentioned elements of the detection system 14 utilized with the optical correlator 10 of this invention, another block 62 of electro-optical material is coupled to an end of one of the fibers, in this instance being fiber 40. The small additional optical path length associated with block 62 is compensated for by the additional fiber length, L, in the other path such that both the optical paths formed by fiber 40 and path 48; and fiber 42 and path 50, respectively, are substantially identical.

Associated with electro-optic block 62 are a pair of electrodes 64 and 66. Electrodes 64 and 66 are positioned on opposite sides of block 62 and are electrically connected to any suitable, variable, controllable voltage source 68. By applying a variable voltage to electrodes 64 and 66, it is possible to alter the effective path length of one of the fibers, for example, fiber 40. Continuing the description of detection system 14, any suitable intensity detector 70, such as a photo-cell or intensity cell, is optically aligned with the output end of optical fiber 44.

METHOD OF CORRELATION

During operation of the optical correlator 10 of this invention, if the wavefronts associated with either components 36 or 38 of readout beam 34 are detected by optical fibers 40 and 42 at the same time, the output of fibers 40 and 42 will be in phase and the intensity at the detector 70 will be at a maximum. If the wavefronts associated with either of the components 36 or 38 of readout beam 34 reach fibers 40 and 42 at different times, the output of the fibers 40 and 42 will be out of phase and the output of the detector will be a lower value or zero. By manipulation of the length of one of the fibers, such as fiber 40 (that is, effectively moving fiber 40 into an out of beam 34 by means of controlling the variable voltage source 68), it is possible to set up a condition in which the output of fibers 40 and 42 will vary periodically in phase and therefore provide a high periodic intensity signal at detector 70. The frequency, f, of this periodic intensity signal is related to the angle of incidence of the corresponding component 36 or 38 of readout beam 34. The techniques of conventional Fourier spectroscopy can be readily applied to such a periodic intensity signal to extract the several frequencies, each frequency corresponding to component 36 or component 38 of readout beam 34. In the particular case described hereinabove, the most intense frequency corresponds to the correlation component 36 of beam 34.

Since the wavefronts of components 36 are parallel and spaced a predetermined distance apart, by the application of (1) appropriate conventional mathematics as set forth hereinbelow, (2) a knowledge of the distance of the effective "movement" of optical fiber 40, and (3) the frequency of the intensity signal, it is possible to determine the direction of the correlation component 36.

Figure 3:
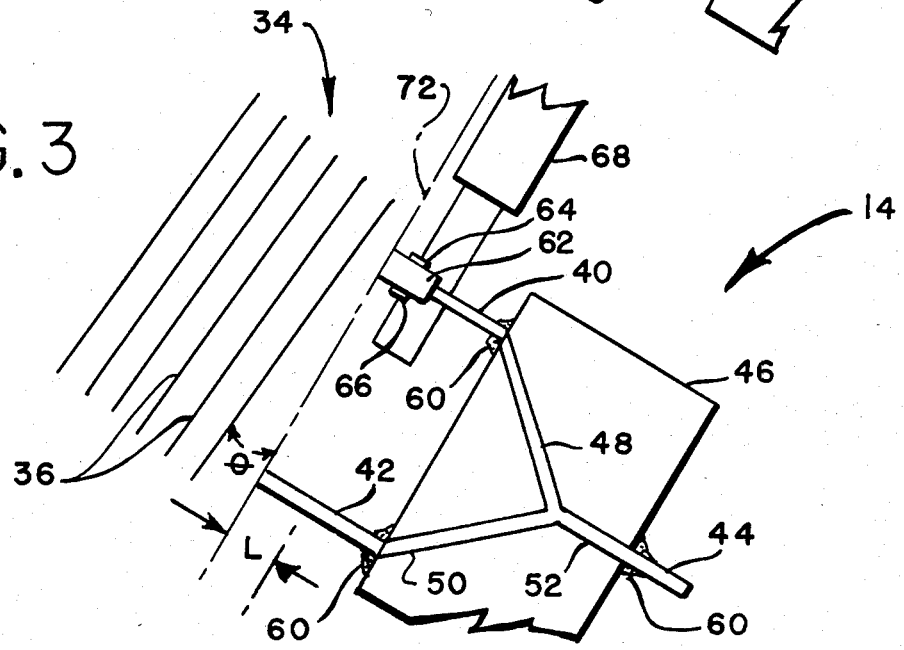
FIG. 3 is a schematic illustration of the detection system of the optical correlator of this invention receiving a beam directed at an angle with respect thereto.

If the wavefronts of component 36 arrive parallel to a line 72 drawn between the end of fiber 42 and the end of electro-optic block 62 as shown in FIG. 2 of the drawing, the output frequency will be at a maximum, $f_m$; where $f_m=\lambda/(dp/dt)$ with $\lambda$=the wavelength of laser 24 and dp/dt=the time rate of change of the optical path length of fiber 40, due to the applied voltage to electrodes 64 and 66. If the frequency, f, of interest (for example, of component 36) has a lower value than $f_m$ then the wavefronts of the component 36 as shown in FIG. 3 of the drawing, will be at angle $\lambda$ with respect to the line 72 drawn between the end of fiber 42 and the end of electro-optic block 52. In such a case, angle $\theta$ can be determined by solving the following equation:

$$\theta = \sin^{-1}((f_m - f)/f_m).$$

Since under normal circumstances, it would be inappropriate to actually physically move one of the fibers 40 into and out of the path of beam 34, precise control of the optical length of fiber 40 is accomplished by the electro-optic block of material 62 when utilized in conjunction with the electrodes 64 and 66 and variable voltage controller 68. Altering the voltage provides the same effect as the physically moving optical fiber 40 into and out of beam path 36.

Although this invention has been described with reference to a particular embodiment, it will be understood to those skilled in the art that this invention is also capable of a variety of alternate embodiments within the spirit and scope of the appended claims. For example, if three dimensional directionality is desired, it would be necessary to only add an orthorgonal pair of optical fibers to the already existing pair of optical fibers 40 and 42.

I claim:

1. An optical correlator comprising:

means for comparing a pair of optical signals and providing a readout beam formed of a plurality of components, each of said components having wavefronts associated therewith and varying in intensity representative of said optical signals; and means for detecting said wavefronts of said components of said readout beam in order to establish a correlation between said optical signals, said detecting means including:

a pair of optical fibers optically interposed within said readout beam, each of said optical fibers having substantially the same optical path length, means optically associated with said pair of optical fibers for combining said optical fibers to form a single optical output path, means operably associated with one of said optical fibers for varying the effective optical path length of said one optical fiber, and means optically aligned with said optical output path for detecting periodic variations in intensities of said wavefronts of said components of said readout beam;

whereby, conventional Fourier spectroscopy techniques can be applied to said detected periodic intensities in order to establish said correlation between said optical signals.

2. An optical correlator as defined in claim 1 wherein said means for varying said effective optical path length of said one optical fiber comprises an electro-optic block of material operably connected to an end of said one optical fiber, a pair of electrodes disposed on opposite sides of said electro-optic block and means electrically connected to said electrodes for applying a varying amount of voltage to said electrodes, whereby said effective optical path length of said one optical fiber can be varied in accordance with said varying amount of voltage applied to said electrodes.

3. An optical correlator as defined in claim 2 wherein said means for combining said pair of optical fibers comprises means for providing a Y-shaped optical path for said pair of optical fibers and said optical output path terminates in a single output optical fiber.

4. An optical correlator as defined in claim 3 wherein said periodic intensity detecting means comprises a photocell.

5. An optical correlator as defined in claim 1 wherein said comparing means comprises a pair of spatial light modulators, a transform lens optically interposed between said modulators, and means for producing said readout beam.

6. An optical correlator as defined in claim 5 wherein said means for varying said effective optical path length of said one optical fiber comprises an electro-optic block of material optically connected to an end of said one optical fiber, a pair of electrodes disposed on opposite sides of said electro-optic block and means electrically connected to said electrodes for applying a varying amount of voltage to said electrodes, whereby the effective optical path length of said one optical fiber can be varied in accordance with said varying amount of voltage applied to said electrodes.

7. An optical correlator as defined in claim 6 wherein said means for combining said pair of optical fibers comprises means for providing a Y-shaped optical path for said pair of optical fibers and said optical output path terminates in a single output optical fiber.

8. A method of correlating a pair of optical signals comprising the steps of:

(a) comparing said pair of optical signals and providing a readout beam formed of a plurality of components having wavefronts associated therewith, said wavefronts of one component varying in intensity from the wavefronts of another component, and being representative of said optical signals;

(b) interposing a pair of optical fibers of substantially the same optical length within said readout beam;

(c) altering the effective optical length of one of said fibers in order to detect a periodic intensity signal;

(d) detecting said periodic intensity signal;

(e) applying techniques of conventional Fourier spectroscopy to said periodic intensity signal in order to extract frequencies therefrom, each of said frequencies corresponding to a component of said readout beam; and (f) relating the most intense of said extracted frequencies to a correlation component corresponding to a correlation between said pair of optical signals.

9. A method of correlating a pair of optical signals as defined in claim 8 further comprising the step of determining the angle of propagation of a particular one of said components of said readout beam.

10. A method of correlating a pair of optical signals as defined in claim 9 wherein said step of determining the angle of propagation of said particular one of said components is established by the following equation: $\theta = \sin^{-1}((f_m - f)/f_m)$; wherein $\theta$=said angle of propagation, $f_m$=the maximum frequency of said component arriving normal to said pair of optical fibers, and f=the frequency of said particular one of said components.

* * * * *